US007954564B2

(12) United States Patent
Makkar et al.

(10) Patent No.: US 7,954,564 B2
(45) Date of Patent: Jun. 7, 2011

(54) PLACEMENT OF CUTTING ELEMENTS ON SECONDARY CUTTING STRUCTURES OF DRILLING TOOL ASSEMBLIES

(75) Inventors: Navish Makkar, Houston, TX (US); Wei Tang, Katy, TX (US); Gordon Whipple, Spring, TX (US); Tommy Laird, Cypress, TX (US); Gail Nelson, Tomball, TX (US)

(73) Assignee: Smith International, Inc., Houston, TX (US)

( * ) Notice: Subject to any disclaimer, the term of this patent is extended or adjusted under 35 U.S.C. 154(b) by 171 days.

(21) Appl. No.: 12/179,469

(22) Filed: Jul. 24, 2008

(65) Prior Publication Data

US 2010/0018779 A1 Jan. 28, 2010

(51) Int. Cl.
*E21B 10/32* (2006.01)

(52) U.S. Cl. ..... 175/263; 175/284; 175/384; 175/406

(58) Field of Classification Search ..... 175/263, 175/267, 384, 344, 385, 406
See application file for complete search history.

(56) References Cited

U.S. PATENT DOCUMENTS

| | | | | | |
|---|---|---|---|---|---|
| 2,846,193 | A * | 8/1958 | Chadderdon | 166/55.7 |
| 2,859,943 | A * | 11/1958 | Chadderdon | 166/55.8 |
| 3,224,507 | A | 12/1965 | Cordary et al. | |
| 3,425,500 | A | 2/1969 | Fuchs | |
| 4,055,226 | A | 10/1977 | Weber | |
| 4,190,124 | A * | 2/1980 | Terry | 175/406 |
| 4,589,504 | A * | 5/1986 | Simpson | 175/267 |
| 5,070,952 | A * | 12/1991 | Neff | 175/426 |
| 5,242,017 | A * | 9/1993 | Hailey | 166/55.8 |
| 7,401,666 | B2 * | 7/2008 | Fanuel et al. | 175/285 |
| 7,658,241 | B2 * | 2/2010 | Lassoie et al. | 175/57 |
| 2004/0211597 | A1 | 10/2004 | Cravatte | |
| 2007/0089912 | A1 * | 4/2007 | Eddison et al. | 175/269 |
| 2008/0128175 | A1 | 6/2008 | Radford et al. | |

FOREIGN PATENT DOCUMENTS

| | | | |
|---|---|---|---|
| GB | 2423546 | A | 8/2006 |
| GB | 2426269 | A | 11/2006 |
| GB | 2453663 | A | 4/2009 |
| WO | 2004/097163 | A1 | 11/2004 |
| WO | 2008/070038 | A1 | 6/2008 |

OTHER PUBLICATIONS

Search Report for related United Kingdom Application No. GB0912314.2 dated Oct. 12, 2009. (5 pages).

* cited by examiner

*Primary Examiner* — Kenneth Thompson
(74) *Attorney, Agent, or Firm* — Osha Liang LLP

(57) ABSTRACT

A secondary cutting structure for sure in a drilling assembly, the secondary cutting structure including a tubular body and a block, extendable from the tubular body, the block including a first arrangement of cutting elements disposed on a first blade and a second arrangement of cutting elements disposed on a second blade, wherein the second arrangement is a modified redundant arrangement. Also, a secondary cutting structure for use in a drilling assembly, the secondary cutting structure including a leading blade disposed on a first block and a trailing blade disposed on the first block adjacent the leading blade. Additionally, the secondary cutting structure includes a unique blade disposed on a second block, wherein a gage portion of at least one of the blades has a length between 30% and 45% of a total blade length.

19 Claims, 11 Drawing Sheets

PLACEMENT OF CUTTING ELEMENTS ON SECONDARY CUTTING STRUCTURES OF DRILLING TOOL ASSEMBLIES

BACKGROUND

1. Field of the Disclosure

Embodiments disclosed herein relate generally to secondary cutting structures for use on drilling tool assemblies. More specifically, embodiments disclosed herein relate to secondary cutting structures having modified redundant cutting arrangements on adjacent blades. More specifically still, embodiments disclosed herein relate to secondary cutting structures having blades with modified redundant arrangements and a gage length between 30% and 45% of a total blade length.

2. Background Art

FIG. 1A shows one example of a conventional drilling system for drilling an earth formation. The drilling system includes a drilling rig 10 used to turn a drilling tool assembly 12 that extends downward into a well bore 14. The drilling tool assembly 12 includes a drilling string 16, and a bottom-hole assembly (BHA) 18, which is attached to the distal end of the drill string 16. The "distal end" of the drill string is the end furthest from the drilling rig.

The drill string 16 includes several joints of drill pipe 16*a* connected end to end through tool joints 16*b*. The drill string 16 is used to transmit drilling fluid (through its hollow core) and to transmit rotational power from the drill rig 10 to the BHA 18. In some cases the drill string 16 further includes additional components such as subs, pup joints, etc.

The BHA 18 includes at least a drill bit 20. Typical BHA's may also include additional components attached between the drill string 16 and the drill bit 20. Examples of additional BHA components include drill collars, stabilizers, measurement-while-drilling (MAX) tools, logging-while-drilling (LWD) tools, subs, hole enlargement devices (e.g., hole openers and reamers), jars, accelerators, thrusters, downhole motors, and rotary steerable systems. In certain BHA designs, the BHA may include a drill bit 20 or at least one secondary cutting structure or both.

In general, drilling tool assemblies 12 may include other drilling components and accessories, such as special valves, kelly cocks, blowout preventers, and safety valves. Additional components included in a drilling tool assembly 12 may be considered a part of the drill string 16 or a part of the BHA 18 depending on their locations in the drilling tool assembly 12.

The drill bit 20 in the BHA 18 may be any type of drill bit suitable for drilling earth formation. Two common types of drill bits used for drilling earth formations are fixed-cutter (or fixed-head) bits and roller cone bits.

In the drilling of oil and gas wells, concentric casing strings are installed and cemented in the borehole as drilling progresses to increasing depths. Each new casing string is supported within the previously installed casing string, thereby limiting the annular area available for the cementing operation. Further, as successively smaller diameter casing strings are suspended, the flow area for the production of oil and gas is reduced. Therefore, to increase the annular space for the cementing operation, and to increase the production flow area, it is often desirable to enlarge the borehole below the terminal end of the previously cased borehole. By enlarging the borehole, a larger annular area is provided for subsequently installing and cementing a larger casing string than would have been possible otherwise. Accordingly, by enlarging the borehole below the previously cased borehole, the bottom of the formation can be reached with comparatively larger diameter casing, thereby providing more flow area for the production of oil and gas.

Various methods have been devised for passing a drilling assembly through an existing cased borehole and enlarging the borehole below the casing. One such method is the use of an underreamer, which has basically two operative states—a closed or collapsed state, where the diameter of the tool is sufficiently small to allow the tool to pass through the existing cased borehole, and an open or partly expanded state, where one or more arms with cutters on the ends thereof extend from the body of the tool. In this latter position, the underreamer enlarges the borehole diameter as the tool is rotated and lowered in the borehole.

A "drilling type" underreamer is typically used in conjunction with a conventional pilot drill bit positioned below or downstream of the underreamer. The pilot bit can drill the borehole at the same time as the underreamer enlarges the borehole formed by the bit. Underreamers of this type usually have hinged arms with roller cone cutters attached thereto. Most of the prior art underreamers utilize swing out cutter arms that are pivoted at an end opposite the cutting end of the cutting arms, and the cutter arms are actuated by mechanical or hydraulic forces acting on the arms to extend or retract them. Typical examples of these types of underreamers are found in U.S. Pat. Nos. 3,224,507; 3,425,500 and 4,055,226. In some designs, these pivoted arms tend to break during the drilling operation and must be removed or "fished" out of the borehole before the drilling operation can continue. The traditional underreamer tool typically has rotary cutter pocket recesses formed in the body for storing the retracted arms and roller cone cutters when the tool is in a closed state. The pocket recesses form large cavities in the underreamer body, which requires the removal of the structural metal forming the body, thereby compromising the strength and the hydraulic capacity of the underreamer. Accordingly, these prior art underreamers may not be capable of underreaming harder rock formations, or may have unacceptably slow rates of penetration, and they are not optimized for the high fluid flow rates required. The pocket recesses also tend to fill with debris from the drilling operation, which hinders collapsing of the arms. If the arms do not fully collapse, the drill string may easily hang up in the borehole when an attempt is made to remove the string from the borehole.

Recently, expandable underreamers having arms with blades that carry cutting elements have found increased use. Expandable underreamers allow a drilling operator to run the underreamer to a desired depth within a borehole, actuate the underreamer from a collapsed position to an expanded position, and enlarge a borehole to a desired diameter. Cutting elements of expandable underreamers may allow for underreaming, stabilizing, or backreaming, depending on the position and orientation of the cutting elements on the blades. Such underreaming may thereby enlarge a borehold by 15-40%, or greater, depending on the application and the specific underreamer design.

Typically, expandable underreamer design includes placing two blades in groups, referred to as blocks, around a tubular body of the tool. A first blade, referred to as a leading blade absorbs a majority of the load, the leading load, as the tool contacts formation. A second blade, referred to as a trailing blade, and positioned rotationally behind the leading blade on the tubular body then absorbs a trailing load, which is less than the leading load. Thus, the cutting elements of the leading blade traditionally bear a majority of the load, while cutting elements of the trailing blade only absorb a majority of the load after failure of the cutting elements of the leading blade. Such design principles, resulting in unbalanced load conditions on adjacent blades, often result in premature failure of cutting elements, blades, and subsequently, the underreamer.

Accordingly, there exists a need for apparatuses and methods of designing secondary cutting structures having unique cutting element, blade, and block design.

SUMMARY OF THE DISCLOSURE

In one aspect, embodiments disclosed herein relate to a secondary cutting structure for sure in a drilling assembly, the secondary cutting structure including a tubular body and a block, extendable from the tubular body, the block including a first arrangement of cutting elements disposed on a first blade and a second arrangement of cutting elements disposed on a second blade, wherein the second arrangement is a modified redundant arrangement.

In another aspect, embodiments disclosed herein relate to a secondary cutting structure for use in a drilling assembly, the secondary cutting structure including a leading blade disposed on a first block and a trailing blade disposed on the first block adjacent the leading blade. Additionally, the secondary cutting structure includes a unique blade disposed on a second block, wherein a gage portion of at least one of the blades has a length between 30% and 45% of a total blade length.

Other aspects and advantages of the invention will be apparent from the following description and the appended claims.

DETAILED DESCRIPTION

In one aspect, embodiments disclosed herein relate to secondary cutting structures for use on drilling tool assemblies. More specifically, embodiments disclosed herein relate to secondary cutting structures having modified redundant cutting arrangements on blades. More specifically still, embodiments disclosed herein relate to secondary cutting structures having blades with modified redundant arrangements and a gage length between 30% and 45% of a total blade length.

Secondary cutting structures, according to embodiments disclosed herein, may include reaming devices of a drilling tool assembly capable of drilling an earth formation. Such secondary cutting structures may be disposed on a drill string downhole tool and actuated to underream or backream a wellbore. Examples of secondary cutting structures include expandable reaming tools that are disposed in the wellbore in a collapsed position and then expanded upon actuation.

Figure 1A:
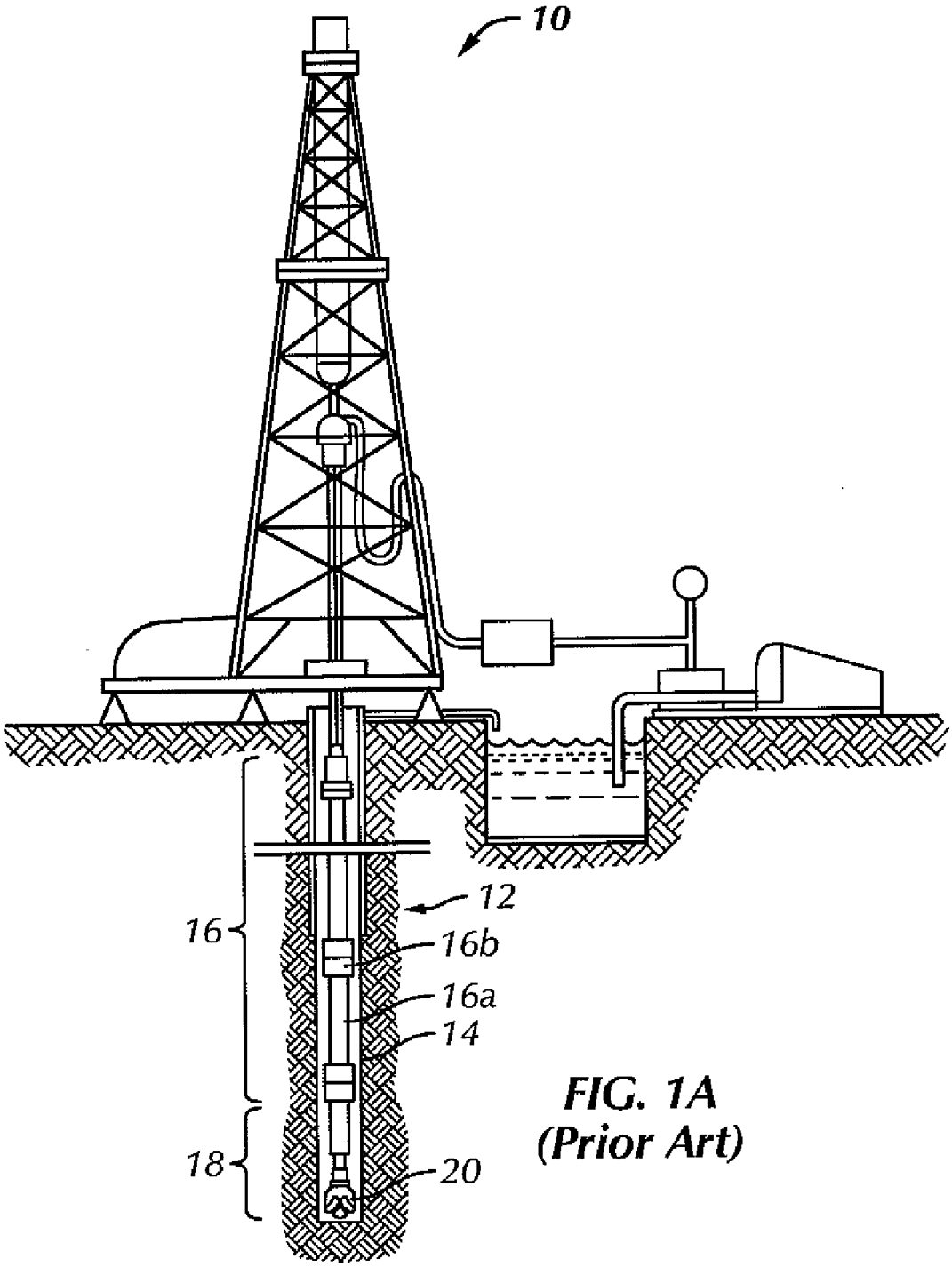
FIG. 1A (Prior Art)
FIG. 1A is a schematic representation of a drilling operation.
Figure 1B:
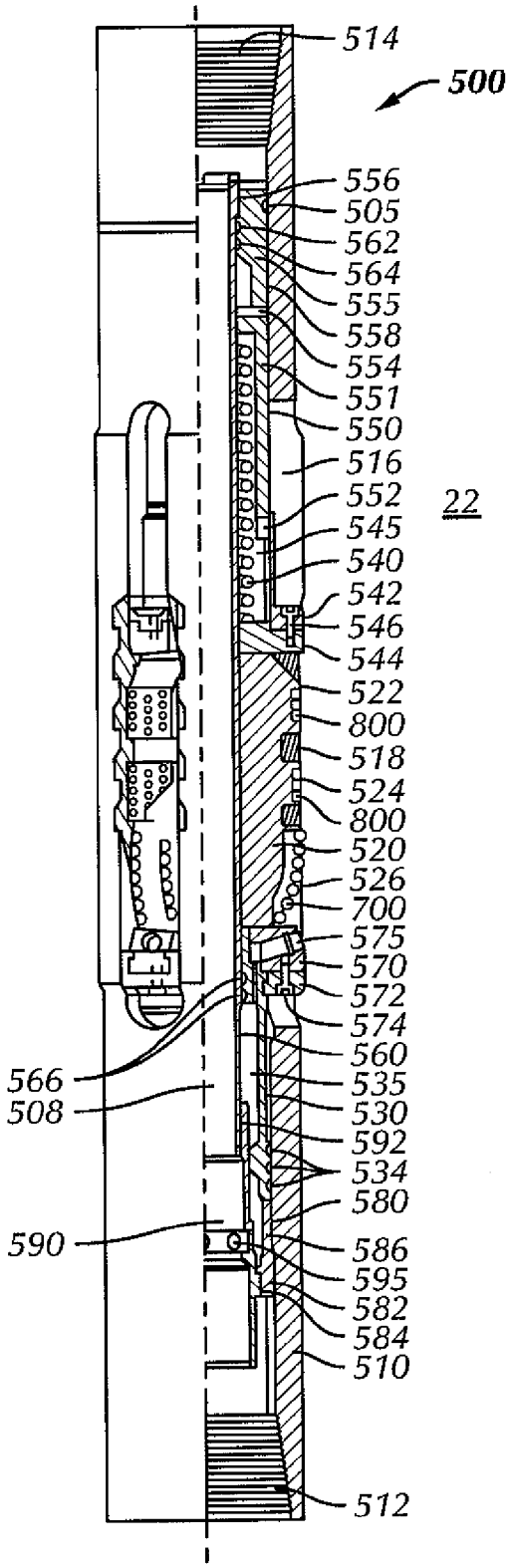
FIGS. 1B and 1C are partial cut away views of an expandable secondary cutting structure.
Figure 1C:
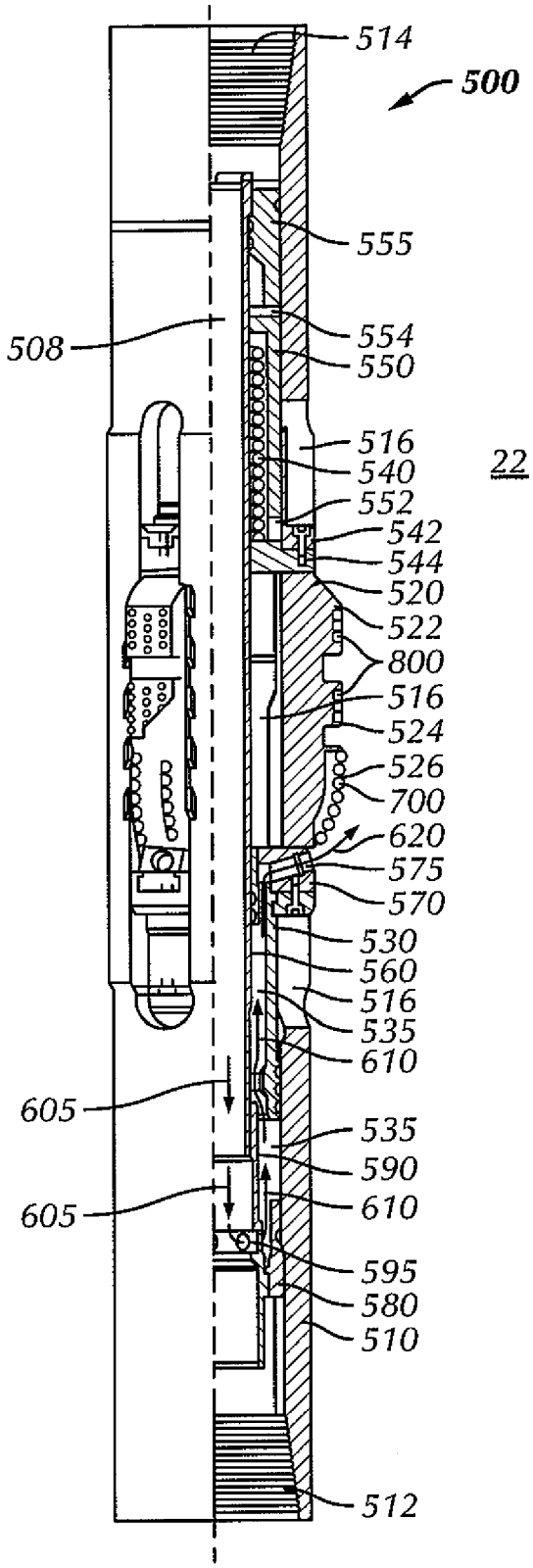

Referring now to FIGS. 1B and 1C, an expandable tool, which may be used in embodiments of the present disclosure, generally designated as 500, is shown in a collapsed position in FIG. 1B and in an expanded position in FIG. 1C. The expandable tool 500 comprises a generally cylindrical tubular tool body 510 with a flowbore 508 extending therethrough. The tool body 510 includes upper 514 and lower 512 connection portions for connecting the tool 500 into a drilling assembly. In approximately the axial center of the tool body 510, one or more pocket recesses 516 are formed in the body 510 and spaced apart azimuthally around the circumference of the body 510. The one or more recesses 516 accommodate the axial movement of several components of the tool 500 that move up or down within the pocket recesses 516, including one or more moveable, non-pivotable tool arms 520. Each recess 516 stores one moveable arm 520 in the collapsed position.

FIG. 1C depicts the tool 500 with the moveable arms 520 in the maximum expanded position, extending radially outwardly from the body 510. Once the tool 500 is in the borehole, it is only expandable to one position. Therefore, the tool 500 has two operational positions—namely a collapsed position as shown in FIG. 1B and an expanded position as shown in FIG. 1C. However, the spring retainer 550, which is a threaded sleeve, may be adjusted at the surface to limit the full diameter expansion of arms 520. Spring retainer 550 compresses the biasing spring 540 when the tool 500 is collapsed, and the position of the spring retainer 550 determines the amount of expansion of the arms 520. Spring retainer 550 is adjusted by a wrench in the wrench slot 554 that rotates the spring retainer 550 axially downwardly or upwardly with respect to the body 510 at threads 551.

In the expanded position shown in FIG. 1C, the arms 520 will either underream the borehole or stabilize the drilling assembly, depending on the configuration of pads 522, 524 and 526. In FIG. 1C, cutting structures 700 on pads 526 are configured to underream the borehole. Depth of cut limiters (i.e., depth control elements) 800 on pads 522 and 524 would provide gauge protection as the underreaming progresses. Hydraulic force causes the arms 520 to expand outwardly to the position shown in FIG. 1C due to the differential pressure of the drilling fluid between the flowbore 508 and the annulus 22.

The drilling fluid flows along path 605, through ports 595 in the lower retainer 590, along path 610 into the piston chamber 535. The differential pressure between the fluid in the flowbore 508 and the fluid in the borehole annulus 22 surrounding tool 500 causes the piston 530 to move axially upwardly from the position shown in FIG. 1B to the position shown in FIG. 1C. A small amount of flow can move through the piston chamber 535 and through nozzles 575 to the annulus 22 as the tool 500 starts to expand. As the piston 530 moves axially upwardly in pocket recesses 516, the piston 530 engages the drive ring 570, thereby causing the drive ring 570 to move axially upwardly against the moveable arms 520. The arms 520 will move axially upwardly in pocket recesses 516 and also radially outwardly as the arms 520 travel in channels 518 disposed in the body 510. In the expanded position, the flow continues along paths 605, 610 and out into the annulus 22 through nozzles 575. Because the nozzles 575 are part of the drive ring 570, they move axially with the arms 520. Accordingly, these nozzles 575 are optimally positioned to continuously provide cleaning and cooling to the cutting structures 700 disposed on surface 526 as fluid exits to the annulus 22 along flow path 620.

The underreamer tool 500 may be designed to remain concentrically disposed within the borehole. In particular, the tool 500 in one embodiment preferably includes three extendable arms 520 spaced apart circumferentially at the same axial location on the tool 510. In one embodiment, the circumferential spacing would be approximately 120 degrees apart. This three-arm design provides a full gauge underreaming tool 500 that remains centralized in the borehole. Wile a three-arm design is illustrated, those of ordinary skill in the art will appreciate that in other embodiments, tool 510 may include different configurations of circumferentially spaced arms, for example, less than three-arms, four-arms, five-arms, or more than five-arm designs. Thus, in specific embodiments, the circumferential spacing of the arms may vary from the 120-degree spacing illustrated herein. For example, in alternate embodiments, the circumferential spacing may be 90 degrees, 60 degrees, or be spaced in non-equal increments. Accordingly, the secondary cutting structure designs disclosed herein may be used with any secondary cutting structure tools known in the art.

Figure 2:
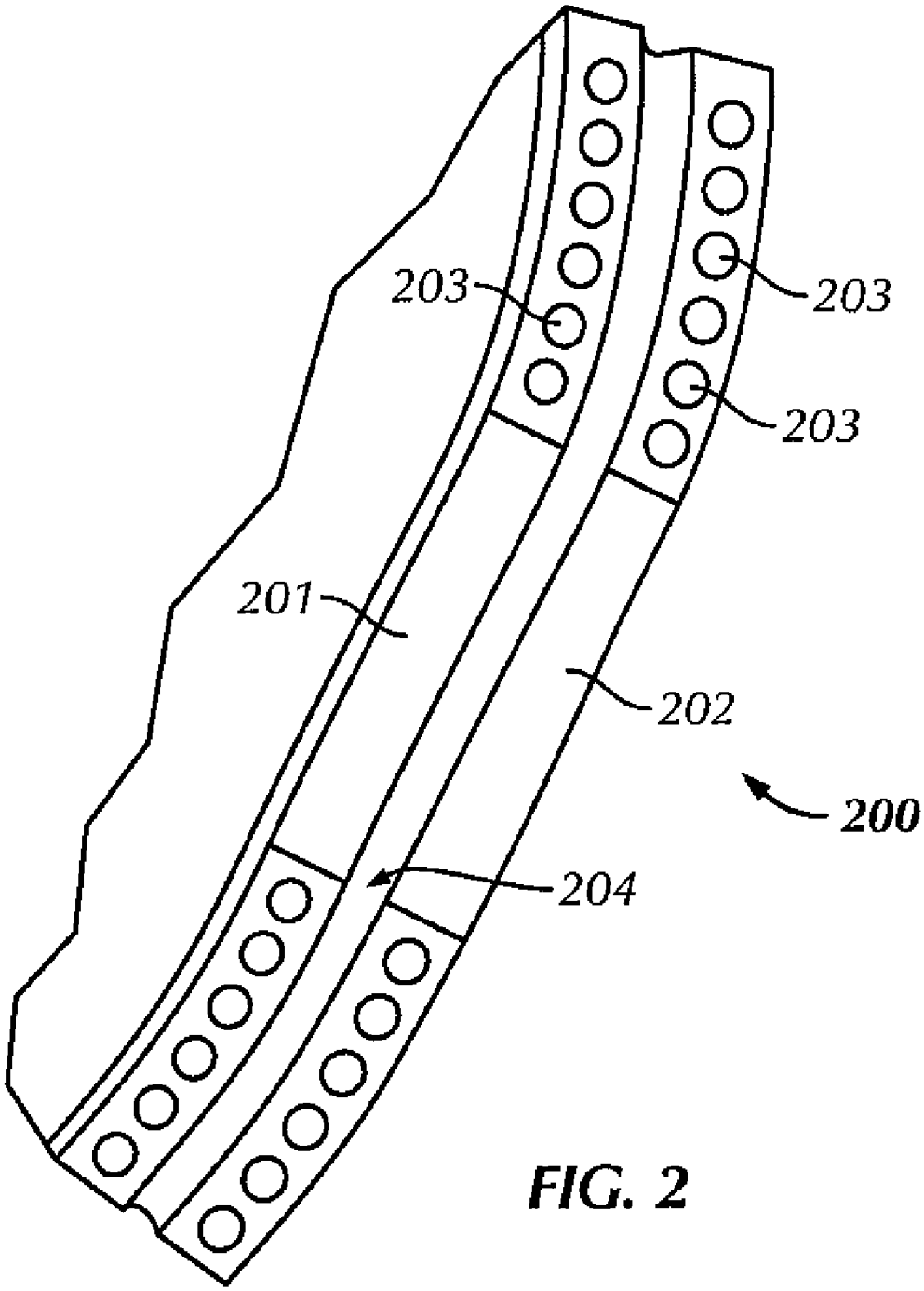
FIG. 2 is an expandable secondary cutting structure block according to embodiments of the present disclosure.

Referring to FIG. 2, two blades according to embodiments of the present disclosure are shown. In this embodiment, block 200 includes a leading blade 201 and a trailing blade 202, and each blade 201 and 202 includes a plurality of cutting elements 203 disposed thereon. As discussed above, a secondary cutting structure typically includes a plurality of blocks 200 of blades 201 and 202. However, in certain embodiments, secondary cutting structures designed in accordance with the present disclosure may include blocks with single or spiral blades. Cutting elements 203 are disposed on blades in specific locations and with a specific orientation to achieve a desired cutting pattern. The position of the individual cutting elements 203 on blades 201 or 202 defines a cutting arrangement.

An example of a cutting arrangement includes a single set arrangement, wherein each blade includes an arrangement of cutting elements 203 different from other blades on the cutting structure. An alternative cutting element arrangement includes a plural set arrangement, wherein each cutting element on trailing blade 202 is redundant to a corresponding cutting element 203 on a preceding (leading) blade 201. In still other embodiments, forward and reverse spiral arrangements may be used, wherein the cutting element arrangement for each blade is unique. Unique cutting element arrangements refer to an arrangement of cutting elements on a blade that is not repeated on another blade of the same secondary cutting structure. Similarly, unique blocks may include an arrangement of cutting elements on both blades that is not repeated in another block on the same secondary cutting structure.

Cutting Element Arrangement

To further explain the cutting element arrangements for secondary cutting structures disclosed herein, individual cutting element arrangements for individual blades and blocks will be discussed in detail below.

Figure 3A:
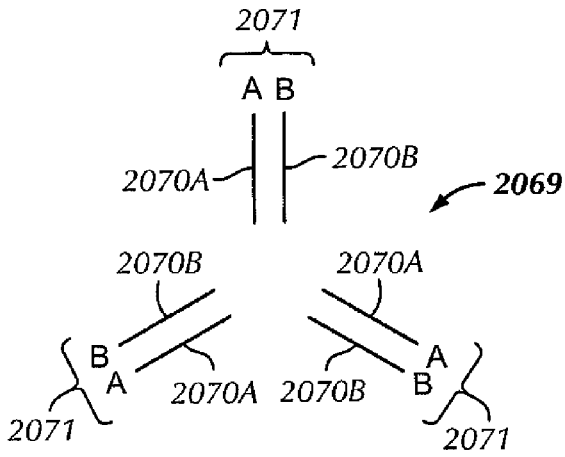
FIGS. 3A-3D are schematic representations of secondary cutting structures according to embodiments of the present disclosure.

Referring to FIG. 3A, a schematic representation of a secondary cutting structure design according to embodiments of the present disclosure is shown. In this embodiment, secondary cutting structure 2069 includes three blocks 2071, each block including two blades, a leading blade 2070A and a trailing blade 2070B. During counterclockwise rotation, leading blade 2070A contacts a formation first, while trailing blade 2070B subsequently contacts the formation. Traditionally, blade design for secondary cutting structures 2069 provided for a first arrangement of cutting elements on leading blades 2070A and a second arrangement of cutting elements on trailing blade 2070B. For example, secondary cutting structure 2069, having three leading blades 2070A and three trailing blades 2070B would include two cutting arrangements. All leading blades 2070A would have a first cutting arrangement, while all trailing blades 2070B would have a second cutting arrangement. Illustration of a first cutting arrangement is designated by reference character "A" and illustration of a second cutting arrangement is designated by reference character "B." Such a secondary cutting structure design is referred to as a 2-3 design (i.e., AB-AB-AB), wherein two cutting element arrangements are each repeated three times. While such cutting element arrangements provide for each block 2071 to be substantially the same, the secondary cutting structure 2069 may not be optimized for drilling under specific drilling conditions or through specific formation types.

Figure 3B:
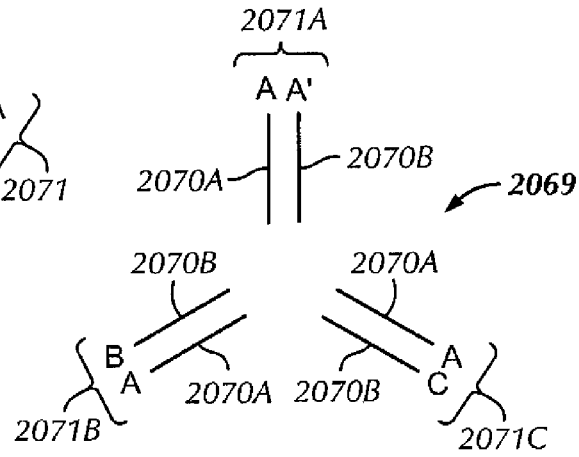

Referring to FIG. 3B, a schematic representation of a secondary cutting structure design according to embodiments of the present disclosure is shown. In this embodiment, secondary cutting structure 2069 also includes three blocks 2071, with each block having two blades, a leading blade 2070A and a trailing blade 2070B. However, instead of having a first and second cutting element arrangement in an AB-AB-AB pattern, such as that of FIG. 3A, FIG. 3B illustrates a modified plural set arrangement, wherein each leading blade 2070A has a same cutting element arrangement (represented by reference character "A"), while each trailing blade 2070B includes a different cutting element arrangement (represented by reference characters "A", "B" and "C"). Blocks 2071B and 7071C include a first cutting arrangement A for each of leading blades 2070A, however, trailing blade 2070B cutting arrangements are unique for each blade.

For example, in one embodiment cutting arrangement A may include twenty total cutting elements disposed in a particular pattern across the length of the blade, while cutting arrangement B includes twenty-one cutting elements, and cutting arrangement C includes twenty-two cutting elements. In other embodiments, design elements that may be varied for each cutting element arrangement include cutting element spacing, cutting element material type, number of cutting elements, blade profile design, and other design elements discussed above and known to those of skill in the art, Additionally, cutting elements may be arranged in single sets, plural sets, or spiral sets, and the arrangements may vary across blocks 2071 and/or blades 2070.

Block 2071A includes a leading blade cutting element arrangement A and a trailing blade cutting element arrangement A'. Cutting element arrangement A' includes identical cutting element position on blades 2070A and 2070B, thereby providing for redundancy, such as in a plural set. However, in addition to providing redundancy through identical cutting element positioning, A' has been modified. Modification may include, for example, changing the exposure of cutting elements of the leading blade 2070A or the trailing blade 2070B, while retaining cutting element positioning, and thus redundancy.

Figure 3C:
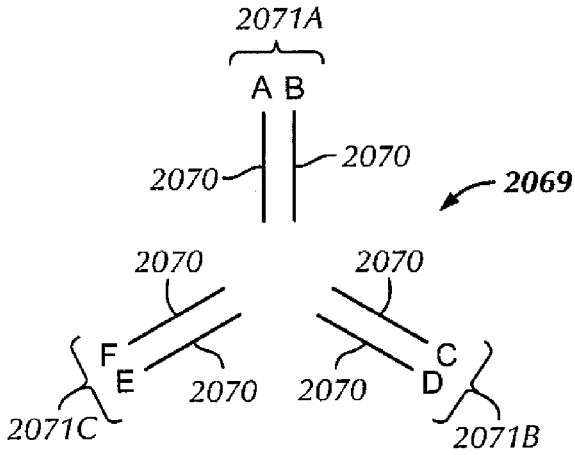
Figure 3D:
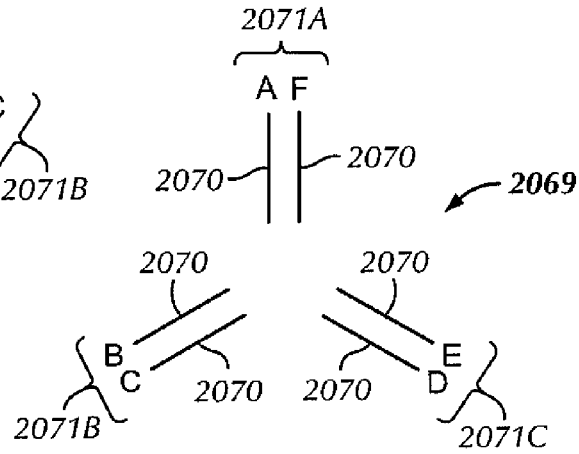

Referring to FIG. 3C, a schematic representation of a secondary cutting structure design according to embodiments of the present disclosure is shown. In this embodiment, secondary cutting structure 2069 includes a forward spiral configuration (clockwise configuration), wherein the arrangement of cutting elements on each blade is unique, such that no cuttings arrangements are duplicated. As such, each block 2071A, 2071B, and 2071C have two different blades 2070, wherein each blade has a unique cutting element arrangement, represented as arrangements A-F. Similarly, referring to FIG. 3D, a schematic representation of a secondary cutting structure design according to embodiments of the present disclosure is shown. In this embodiment, secondary cutting structure 2069 includes a reverse spiral configuration (counterclockwise configuration), wherein the arrangement of cutting elements on each blade is unique, such that no cuttings arrangements are duplicated. Accordingly, each blade 2070 includes a unique cutting element arrangement (represented as reference characters A-F), and the blades 2070 are disposed around the tool a counterclockwise configuration.

Those of ordinary skill in the art will appreciate that the combinations of single and plural sets, as well as forward and reverse spiral sets used may vary according to the design requirements for a specific secondary cutting structure. Accordingly, a single secondary cutting structure may include one or more cutting arrangements, as discussed above. Along with variations in the cutting element arrangement, specific design elements for blocks, blades, and individual cutting elements may be modified to produce a desired arrangement. Specific examples of design variations that may be considered in designing cutting structures in accordance with the present disclosure are discussed in detail below.

Design Elements of Secondary Cutting Structure

Figure 4:
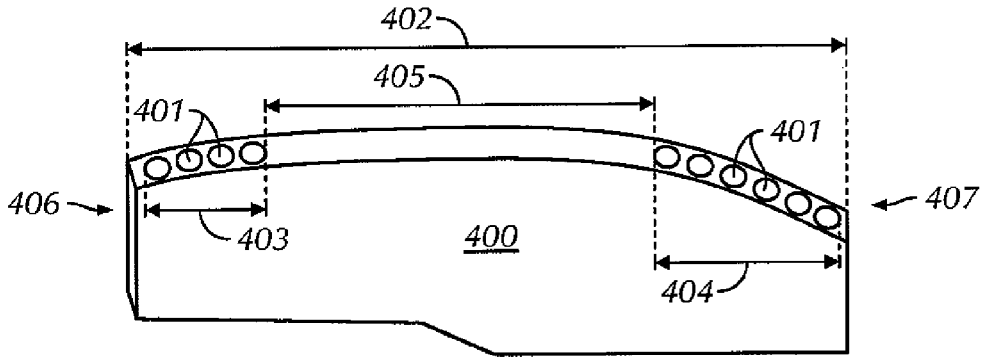
FIG. 4 is a side view of an expandable cutter block blade according to embodiments of the present disclosure.

Referring to FIG. 4, a blade of a secondary cutting structure according to embodiments of the present disclosure is shown. In this embodiment, blade 400 includes a plurality of cutting elements 401 disposed thereon. The blade 400 includes a first cutting portion 403, a second cutting portion 404, and a gauge portion 405. First cutting portion 403 includes a plurality of cutting elements 401 disposed at a first end 406 of the blade 400, and may be used in operation to backream a wellbore. Second cutting portion 404 includes a plurality of cutting elements 401 disposed at a second end 407 of the blade 400, and may be used in operation to underream a wellbore. During operation, gauge portion 405 may contact the sidewalls of a wellbore to either remove formation or stabilize the tool. A total blade length 402 includes all cutting portions, in this embodiment first and second cutting portions 403 and 404, as well as gauge portion 405.

In one embodiment, gauge portion 405 is greater than 30% of the total blade length 402. By increasing the ratio of gauge portion 405 to total blade length 402, the net radial cutting forces imparted to blade 400 during drilling may be decreased. Decreasing the radial cutting force allows the dynamic radial imbalance force generated during longitudinal drilling to be decreased as well, thereby decreasing undesirable vibrations during drilling, and increasing stability. In certain embodiments, gauge portion 405 may be elongated to include between 30% and 45% of the total blade length 402. By further increasing gauge portion 405 length relative to total blade length 402, radial cutting forces may be further decreased, thereby resulting in increased drilling tool assembly stability. Those of ordinary skill in the art will appreciate that the specific ratio of gauge portion 405 to total blade length 402 may be varied according to the specific requirements of the drilling operation, such as formation properties (e.g., rock hardness) and drilling parameters (e.g., weight-on-bit, revolutions per minute, drilling fluid flow rate, etc.). Additionally, other design elements of the secondary cutting structure may be used to determine an optimal gauge portion 405 lengths. Examples of other design elements include cutting element back rake angle, cutting element side rake angle, cutting element type, cutting element material, blade-to-blade angle, blade position, cutting element arrangement, and cutting element exposure.

Still referring to FIG. 4, gauge portion 405 illustrates a passive gauge design. Typically, gauge portions 405 of blades 400 of secondary cutting structures included cutting elements 401 configured to contact the formation to either remove formation or stabilize the tool. However, such radial contact of cutting elements 401 disposed along the gauge may actually increase dynamic radial imbalance forces, thereby decreasing the stability of the tool. As such, embodiments disclosed herein may include a passive gauge portion 405 that either does not include cutting elements 401, or alternatively, may include depth of cut limiters (not illustrated) configured to prevent blade 400 from directly contacting the formation. While depth of cut limiters may engage the formation at some point during drilling, they do not actively cut the formation, rather, the depth of cut limiters may prevent damage to blade 400 from inadvertent blade 400 to sidewall contact. As such, a gauge portion 405 including depth of cut limiters, or other components, configured to protect blade 400, while not actively engaging the sidewalls of the wellbore, may still be included in a passive gage design.

Figure 5:
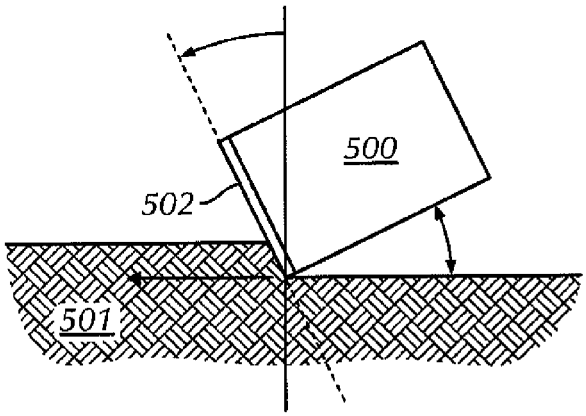
FIG. 5 is a schematic representation of a cutting element cutting formation according to embodiments of the present disclosure.

Referring to FIG. 5, a schematic illustration of a cutting element contacting formation, according to embodiments of the present disclosure is shown. In this embodiment, cutting element 500 is shown contacting formation 501, as the cutting element 500 moves in direction A. One design element that may be modified in a cutting element arrangement, according to embodiments disclosed herein, includes the back rake angle of individual cutting elements 500. Back rake angle defines the aggressiveness of the cutter, and is defined as the angle between the normal direction of cutting element movement 503 and a cutting element face plane 502. Accordingly, a cutting element 500 having 0° of back rake would be perfectly perpendicular to the formation being drilled.

In typical secondary cutting structure design, large back rake angles (i.e., back rake angles greater than 20°) have been used to reduce cutting element failure by decreasing impact loading. However, in accordance with embodiments disclosed herein, decreasing back rake angle to less than 20°, thereby increasing the aggressiveness of the cut, may increase the stability of the secondary cutting structure. Decreasing the back rake angle may actually decrease lateral vibrations experienced by the secondary cutting structure by, among other things, matching the aggressiveness of the secondary cutting structure to the aggressiveness of an associated drill bit or primary cutting structure. Allowing both the primary and the secondary cutting structure to cut formation with a similar aggressiveness may decrease vibrations of the entire drilling tool assembly, thereby increasing the stability of the drilling tool assembly.

Figure 6:
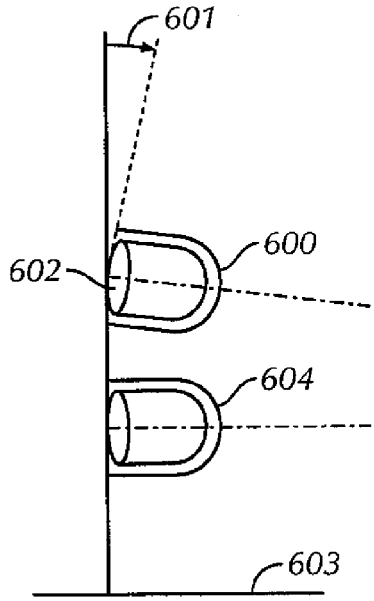
FIG. 6 is a schematic representation of a cutting element cutting formation according to embodiments of the present disclosure.

Referring to FIG. 6, a schematic illustration of a cutting element according to embodiments of the present disclosure is shown. In this embodiment, cutting element 600 is illustrated moving in direction A, and includes an increased side rake angle 601. Side rake angle 601 is the angle between the cutting element face 602 and the radial plane of the secondary cutting structure centerline 603. As such, cutting element 604 is illustrated having 0° of side rake, while cutting element 600 is illustrated having greater than 5° of side rake. In typical secondary cutting structure design, side rake angle 601 is approximately 0°, as indicated by cutting element 604. However, according to embodiments of the present disclosure, side rake angle 601 of one or more of the cutting elements of the secondary cutting structure may have a value, for example, approximately ±10°. By increasing side rake 601, circumferential cutting forces acting along cutting element edges may be balanced. Balancing the load on individual cutting elements may decrease cutting element fatigue, and thus prevent premature cutting element failure. In certain embodiments, the side rake angle 601 may be increased to ±10°, while in some embodiments, the preferred side rake angle may be ±5°. Those of ordinary skill in the art will appreciate that the specific side rake angle used will depend on other design elements of the specific secondary cutting structure, and as such, only certain cutting elements in a cutting element arrangement may include a side rake angle of greater than 0°.

Figure 7:
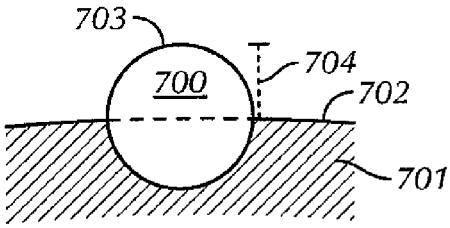
FIG. 7 is a front view of a cutting element disposed on a blade according to embodiments of the present disclosure.
Figure 8:
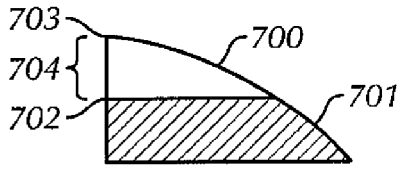
FIG. 8 is a side view of a cutting element disposed on a blade according to embodiments of the present disclosure.

Referring to FIGS. 7 and 8, front and side views of a cutting element according to embodiments of the present disclosure are shown. In addition to the design element modifications discussed above, a cutting element exposure may also be modified according to embodiments of the present disclosure. In this embodiment, cutting element 700 is disposed along a blade 701. Cutting element exposure refers to the distance from an edge of a blade 702 to an edge of an exposed cutting element 703. Thus, the cutting element exposure for cutting element 700 is illustrated by reference character 704. In accordance with embodiments disclosed herein, cutting element exposure may be decreased to half the diameter (i.e., 50% of the diameter of the cutting element) of the cutting element. Such a cutting element exposure may thereby provide for adequate hydraulic flow around the cutting element, thereby promoting the evacuation of cuttings, while still preventing the blade 701 from directly contacting the formation. In other embodiments, cutting element 700 may be exposed 15%, 25%, 35%, or to another exposure less than 50%. Those of ordinary skill in the art will appreciate that cutting element exposure is another design element that may be modified in accordance with the secondary cutting structure designs disclosed herein.

In addition to individual cutting element exposure, the relative exposure of cutting elements on successive blades may be modified. Referring back to FIG. 2, a block 200 according to embodiments of the present disclosure is shown. In this embodiment, block 200 includes a leading blade 201 and a trailing blade 202. Each blade 201 and 202 includes a plurality of cutting elements 203 disposed thereon. To balance the blade-to-blade load distribution during drilling, cutting elements 203 of leading blade 201 may have decreased exposure relative to cutting elements of trailing blade 202, or cutting elements of trailing blade 202 may have increased exposure relative to leading blade 201.

Figure 9A:
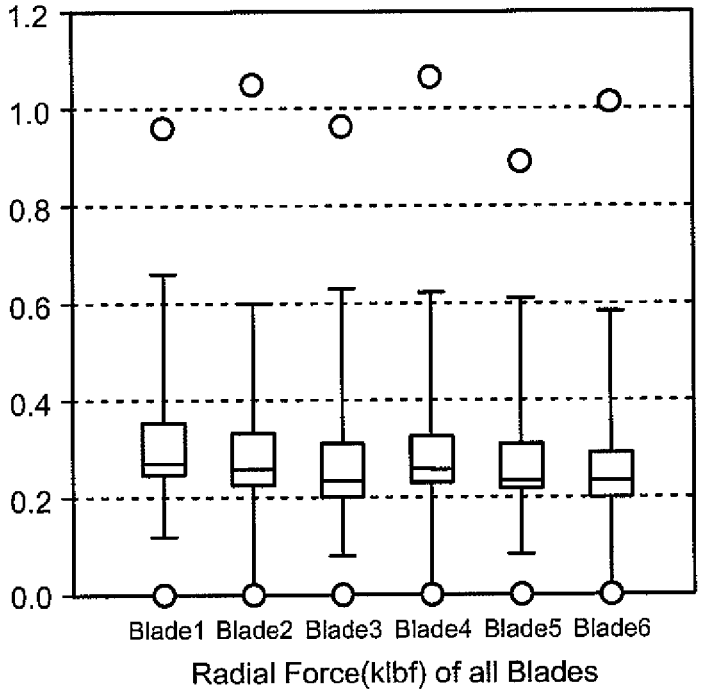
FIGS. 9A-10C are graphical representations of forces produced by secondary cutting structures according to embodiments of the present disclosure.
Figure 9B:
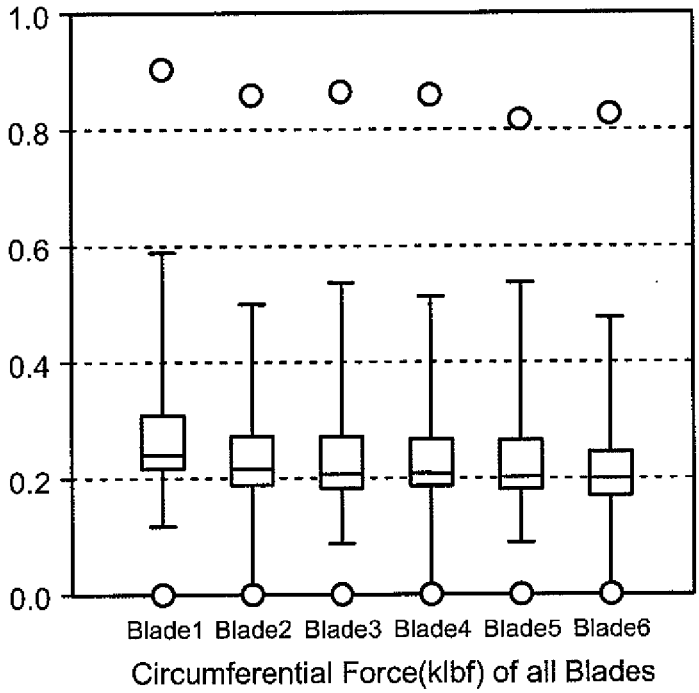
Figure 9C:
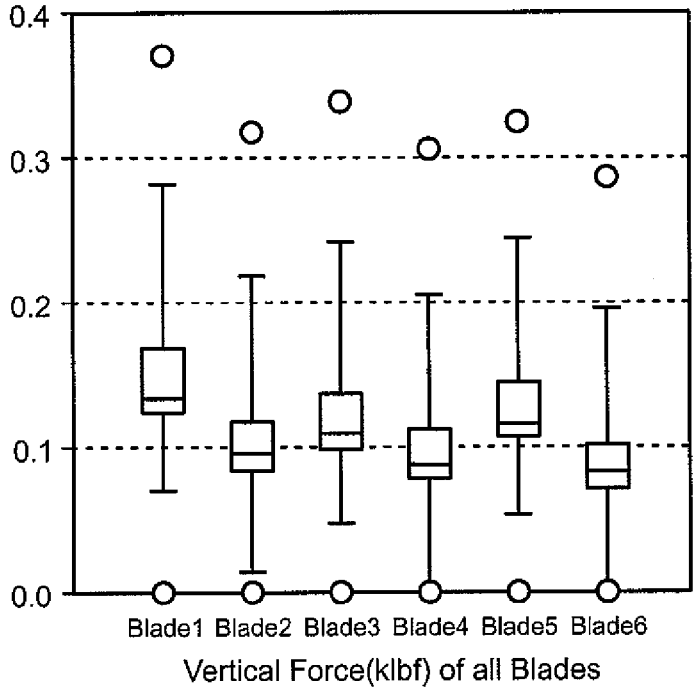
Figure 10A:
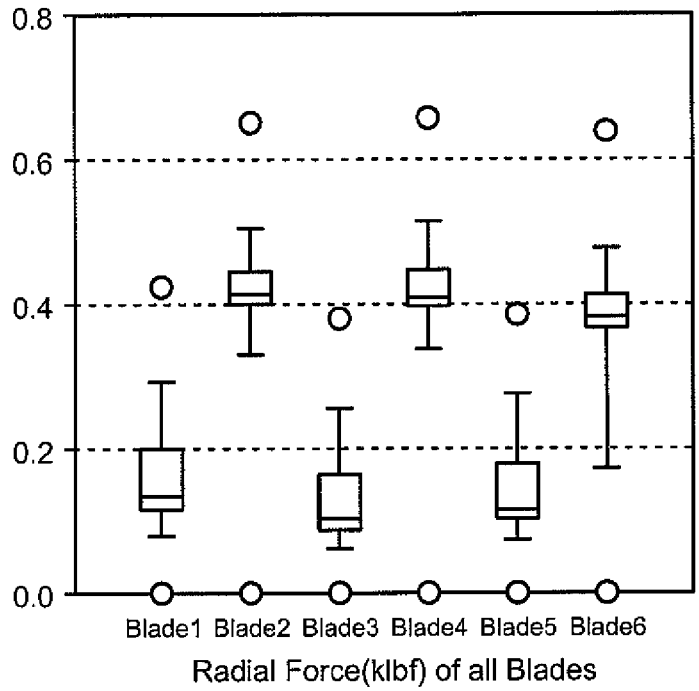
Figure 10B:
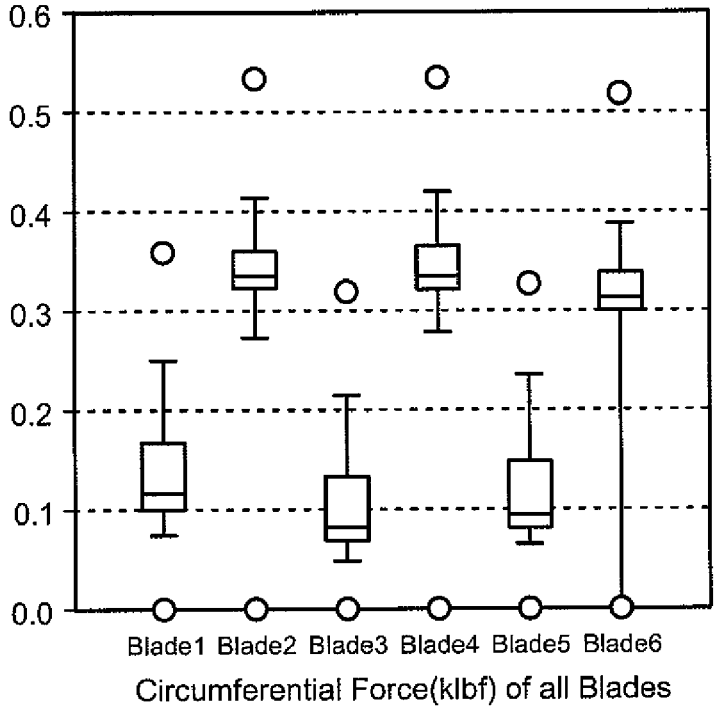
Figure 10C:
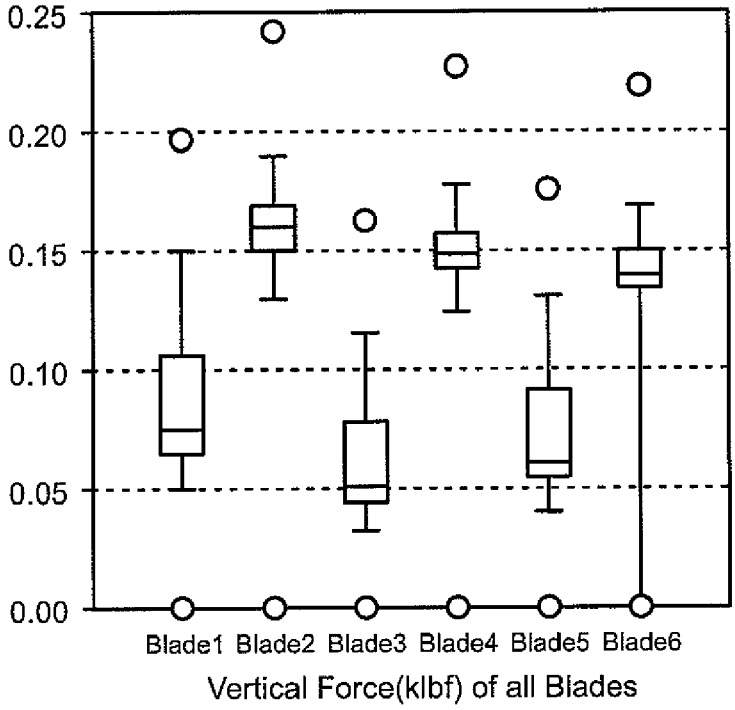

In certain embodiments, the exposure of trailing blade 203 may be increased (over exposed), or the exposure of leading blade 202 may be decreased (under exposed), such that upon contact with formation, the load distribution of cutting elements of both leading blade 202 and trailing blade 203 is substantially balanced. Such a configuration may be referred to as a balanced exposure, because trailing blade 203 is exposed so as to balance the load on cutting elements of leading blade 202 and trailing blade 203 during use. Referring to FIGS. 10A-10C, graphical plots of forces on blades of a secondary cutting structure having a balanced exposure according to embodiments of the present disclosure are shown. Specifically, FIG. 9A illustrates radial forces on blades, FIG. 9B illustrates circumferential forces on blades, and FIG. 9C illustrates vertical/axial forces on blades. In this embodiment, leading blades 1, 3, and 5 have 0.010" less exposure than trailing blades 2, 4, and 6. The result of decreasing leading blade exposure is a substantially balanced radial, circumferential, and vertical/axial force load between all blades, as is illustrated in FIGS. 10A-10C.

In other embodiments, leading blade 202 may be exposed less than trailing blade 203, such that the forces on trailing blades are increased relative to the forces on leading blades. Referring to FIGS. 10A-C, graphical plots of forces on blades of a secondary cutting structure having a reversed exposure according to embodiments of the present disclosure are shown. Specifically, FIG. 10A illustrates radial forces on blades, FIG. 10B illustrates circumferential forces on blades, and FIG. 10C illustrates vertical/axial forces on blades. In this embodiment, leading blades 1, 3, and 5 have 0.020" less exposure than trailing blades 2, 4, and 6. The result of decreasing leading blade exposure is a reversed radial, circumferential, and vertical/axial force load between leading and trailing blades, as is illustrated in FIGS. 10A-10C. Determining the amount of exposure for leading and/or trailing blades may include simulating, determining, and analyzing the blades, as discussed above. This exposure technique allows cutting elements of the trailing blade to take relatively more load than the cutting elements of the leading blade. The leading blade may thereby serve as a protective blade for the trailing blade, such that trailing blade is protected, and as such, may be less likely to be damaged or experience premature failure.

Figure 11:
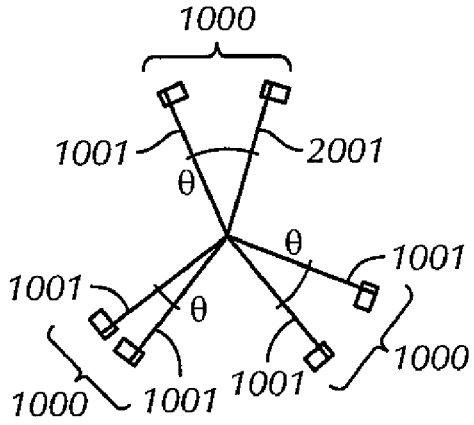
FIG. 11 is a schematic representation of a secondary cutting structure according to embodiments of the present disclosure

In still other embodiments, the placement of blades 202 and 203 on block 200 may be selected according to a desired blade-to-blade angle, or the relative angular orientation of two or more blades 202 and/or 203. Referring briefly to FIG. 11, a schematic representation of a secondary cutting structure according to embodiments of the present application is shown. In this embodiment, three blocks 1000, each having two blades 1001 are illustrated, wherein each blade 1001 on a specific block relative to another blade 1001 on the same block 1000 has a specified blade-to-blade angle θ. As illustrated, blade-to-blade angle θ may be different for each block 1000. However, in certain embodiments disclosed herein, a blade-to-blade angle θ of between 15° and 22° may be preferable. Such a blade-to-blade angle θ may increase the efficiency and integrity of the secondary cutting structure. Those of ordinary skill in the art will appreciate that the circumferential spacing of blocks 1000 may remain consistent, even if blade-to-blade angles θ between individual blades 1001 of a block 1000 are different. Similarly, blade-to-blade angles θ of each block 1000 may be the same, even if the circumferential spacing of individual blocks 1000 around the body of the tool are different.

Referring back to FIG. 2, block 200 also includes a flow channel disposed between leading blade 201 and trailing blade 202. Flow channel 204 allows drilling fluid, including drill cuttings removed by the secondary cutting structure and/or drill bit, to pass through the secondary cutting structure. Flow channel 204 may thereby provide for enhanced hydraulic flow, increasing cuttings evacuation from the wellbore, as well as provide increased cooling and lubrication to cutting elements 203 of the secondary cutting structure. Those of ordinary skill in the art will appreciate that in addition to the specific design elements discussed above, other design modifications may be incorporated into aspects of the cutting element arrangements disclosed herein.

Exemplary Secondary Cutting Structure Design

To further illustrate different cutting element arrangements and modifications to individual cutting elements, blades, and blocks, exemplary secondary cutting structures in accordance with embodiments disclosed herein are discussed in detail below.

Figure 12:
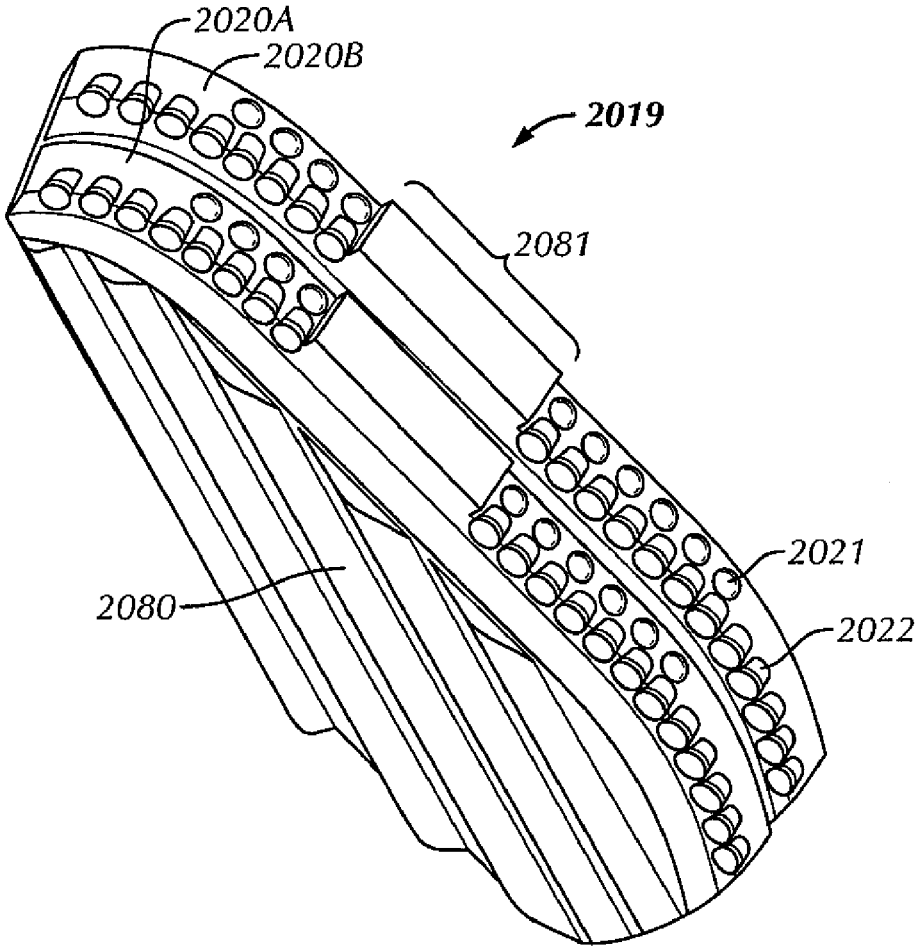
FIG. 12 is a close perspective view of an expandable secondary cutting structure according to embodiments of the present disclosure.

Referring to FIG. 12, a modified secondary cutting structure, according to embodiments of the present disclosure is shown. As illustrated the secondary cutting structure includes a block 2019 having a leading blade 2020A and a trailing blade 2020B, with cutting elements 2022 and depth of cut limiters 2021 disposed thereon. In this embodiment, blade 2020 includes a plurality of tungsten carbide inserts 2021 as depth of cut limiters, and the back rake angle of one or more cutting elements 2022 is adjusted to be about 15°.

Blades 2020 also include a gauge portion 2080 that is passive 2081. In this embodiment, passive gage portion 2080 does not include cutting elements, however, in alternate embodiments, a passive gauge portion 2081 may include elements configured to protect blades 2020, while not actively cutting formation. For example, in certain embodiments, passive gauge portion 2081 may include one or more tungsten carbide inserts configured to prevent direct blade-to-formation contact, thereby protecting the blade from premature wear.

Additionally, in this embodiment, gauge portion 2080 includes a portion that is 45% of the total blade length. By increasing the gauge portion 2080 to include more of the total blade length, and by including a passive gauge portion 2081, the radial cutting force during normal longitudinal drilling is decreased. Decreasing the radial cutting force allows the dynamic radial imbalance force generated during longitudinal drilling to be decreased as well, thereby decreasing undesirable vibrations during drilling. In still other embodiments, gauge portion 2080 may be 30% to 45% of the total blade length depending on the formation being drilled, operating parameters used, and/or other design elements of the secondary cutting structure.

Still referring to FIG. 12, cutting elements 2022 of leading blade 2020A are arranged in a redundant pattern to the cutting elements 2022 of trailing blade 2020B, thereby providing for a plural set blade pattern. In such plural sets, each cutting element on trailing blade 2020B is redundant to a corresponding cutting element 2022 on preceding, leading blade 2020A. In a plural set blade pattern, the leading blade 2020A may include cutting elements 2022 in positions in addition to those on trailing blade 2020B, but the reverse is not true. Therefore, each cutting element 2022 on trailing blade 2020B has a corresponding cutting element 2022 on leading blade 2020A that has generally equivalent radial and axial spacing. The arrangement of cutting elements 2022 between leading blade 2020A and trailing blade 2020B are therefore redundant. In other embodiments, trailing blade 2020B may include more cuttings elements 2022 than leading blade 2020A, thereby allowing trailing blade 2020B to act as a dynamic leading blade, because the trailing blade 2020B will be dynamically leading, leading blade 2020A Redundant cutting elements 2022 may provide for increased durability of individual cutting elements 2022. Because each redundant cutting element 2022 follows essentially the same path as the corresponding cutting element 2022, the cutting element 2022 of the leading blade 2020A clears some formation for the redundant cutting element 2022, thereby subjecting the redundant cutting element 2022 to less resistance, and thus less wear. By decreasing the resistance placed on redundant cutting elements 2022, mechanical failure, such as cracking of the cutting elements 2022, may be decreased.

In addition to the selection of single or plural set profiles, another option for a secondary cutting structure design in accordance with embodiments disclosed herein is a modified plural set profile. In such a profile, trailing blade 2020B includes redundant cutting elements 2022 corresponding to cutting elements 2022 of leading blade 2020A, however, trailing blade 2020B may be modified to change, for example, an exposure of cutting elements 2022 of trailing blade 2020B.

Figure 13:
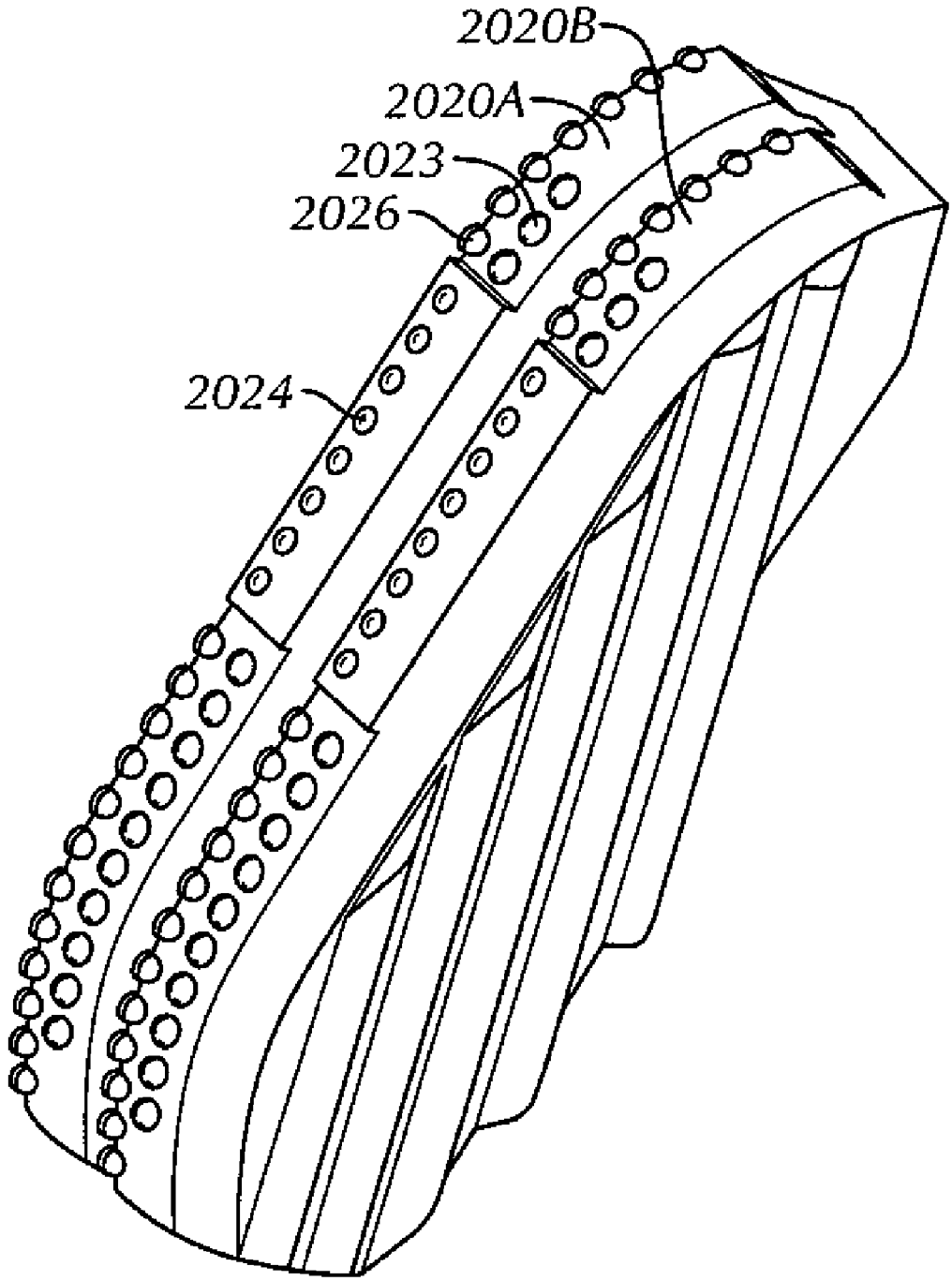
FIG. 13 is a close perspective view of an alternative expandable secondary cutting structure according to embodiments of the present disclosure.

Referring to FIG. 13, an alternative modified secondary cutting structure, according to embodiments of the present disclosure, is shown. In this embodiment, blades 2023A and 2023B include additional components, specifically, diamond enhanced inserts 2024 for gauge protection, and tungsten carbide cutting inserts 2025 as depth of cut limiters. Additionally, blade 2023 also includes a back rake angle of less than 20°.

As illustrated, depth of cut limiters 2025 are disposed behind cutting elements 2026 on both leading blade 2023A and trailing blade 2023B. Depth of cut limiters 2025 may include inserts with cutting capacity, such as back up cutters or diamond impregnated inserts with less exposure than primary cutting elements 2026, or diamond enhanced inserts, tungsten carbide inserts, or other inserts that do not have a designated cutting capacity. While depth of cut limiters 2025 do not primarily engage formation during drilling, after wear of primary cutting elements 2026, depth of cut limiters 2025 may engage the formation to protect the primary cutting elements 2026 from increased loads as a result of worn primary cutting elements 2026. Depth of cut limiters 2025 are disposed behind primary cutting elements 2026 at a selected distance, such that depth of cut limiters 2025 may remain unengaged with formation until wear to primary cutting elements 2026 occurs.

After depth of cut limiters 2025 engage formation, due to wear of primary cutting elements 2026, the load that would normally be placed upon primary cutting elements 2026 is redistributed, and per cutter force may be reduced. Because the per cutter force may be reduced, primary cutting elements 2026 may resist premature fracturing, thereby increasing the life of the primary cutting elements 2026. Additionally, redistributing cutter forces may balance the overall weight distribution on the secondary cutting structure, thereby increasing the life of the tool. Furthermore, depth of cut limiters 2025 may provide dynamic support during wellbore enlargement, such that the per cutter load may be reduced during periods of high vibration, thereby protecting primary cutting elements 2026 and/or backup cutting elements (not illustrated). During period of increased drill string bending and off-centering, depth of cut limiters 2025 may contact the wellbore, thereby decreasing lateral vibrations, reducing individual cutter force, and balancing torsional variation, so as to increase durability of the secondary cutting structure and/or individual cutting elements 2026.

Advantageously, embodiments of the present disclosure may provide for cutting element arrangements for secondary cutting structures that result in a balanced load distribution between individual cutting elements and individual blades of a secondary cutting structure. Additionally, cutting element arrangements disclosed herein may advantageously provide for balanced forces along entire drilling tool assemblies by reducing lateral and torsional vibrations.

In still other embodiments, aspects of the present disclosure may advantageously provide for stabilized secondary cutting structures that provide for balanced forced during drilling. Additionally, secondary cutting structures may be adjusted to optimize individual design elements, thereby resulting in decreased failure rates and premature wear to cutting elements and/or secondary cutting structures. Furthermore, the secondary cutting structure design methods disclosed herein may allow for secondary cutting structure designs that are optimized relative to specific primary cutting structure designs. Thus, optimized drilling tool assemblies may be designed to have higher ROPs, increased life, and are less likely to experience premature wear.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed:

1. A secondary cutting structure for use in a drilling assembly, the secondary cutting structure comprising:
- a tubular body;
- a block, extendable from the tubular body, the block comprising:
  - a first arrangement of cutting elements disposed on a first blade; and
  - a second arrangement of cutting elements disposed on a second blade, wherein the second arrangement is a modified redundant arrangement
  - wherein at least one of a plurality of cutting elements are disposed on at least one blade with a back rake angle of 20° or less.

2. The secondary cutting structure of claim 1, wherein a gage portion of at least one of the blades has a length between 30% and 45% of a total blade length.

3. The secondary cutting structure of claim 1, wherein an angle between the first and second blades is between 15° and 22°.

4. The secondary cutting structure of claim 1, wherein at least one of the first and second blades comprises depth control elements disposed behind the cutting elements.

5. The secondary cutting structure of claim 1, wherein the first and second blades are disposed in a balanced configuration.

6. The secondary cutting structure of claim 5, wherein the balanced configuration comprises a reverse exposure of the second blade to the first blade.

7. The secondary cutting structure of claim 5, wherein the first and second blades are configured to provide a substantially balanced load distribution during drilling.

8. The secondary cutting structure of claim 1, wherein the block comprises a flow channel.

9. The secondary cutting structure of claim 1, further comprising:
- a second block, the second block comprising:
  - a third arrangement of cutting elements disposed on a third blade; and
  - a fourth arrangement of cutting elements disposed on a fourth blade;
  - wherein at least one of the third and fourth arrangements of cutting elements is the same as one of the first and second arrangements of cutting elements.

10. The secondary cutting structure of claim 9, further comprising:
- a third block, the third block comprising:
  - a fifth arrangement of cutting elements disposed on a fifth blade; and
  - a sixth arrangement of cutting elements disposed on a sixth blade;
  - wherein at least one of the fifth and sixth arrangements of cutting elements is the same as one of the first and second arrangements of cutting elements.

11. The secondary cutting structure of claim 1, wherein the cutting elements comprise a spiral set configuration.

12. A secondary cutting structure for use in a drilling assembly, the secondary cutting structure comprising:
- a leading blade disposed on a first block;
- a trailing blade disposed on the first block adjacent the leading blade; and
- a unique blade disposed on a second block;
- wherein a gage portion of at least one of the blades has a length between 30% and 45% of a total blade length and
- wherein at least one of the blades comprises an under exposed cutting element arrangement.

13. The secondary cutting structure of claim 12, wherein cutting elements of the leading and trailing blades comprise a plural set configuration.

14. The secondary cutting structure of claim 13, further comprising:
- a third blade disposed on the second block;
- wherein the third blade comprises a cutting element arrangement of the leading or trailing blades.

15. The secondary cutting structure of claim 12, further comprising:
- a third blade disposed on a third block;
- wherein the third blade comprises a unique arrangement of cutting elements.

16. The secondary cutting structure of claim 12, further comprising:
- a third blade disposed on the second block;
- wherein the third blade comprises a cutting element arrangement of at least one of the cutting element arrangements of the leading blade or the trailing blade.

17. The secondary cutting structure of claim 12, wherein at least one of a plurality of cutting elements is disposed on at least one of the blades with a back rake angle of 15° or less.

18. The secondary cutting structure of claim 12, wherein at least one of a plurality of cutting elements is disposed on at least one of the blades with a side rake angle in the range of about ±10°.

19. The secondary cutting structure of claim 12, wherein at least one of the blades comprises a reverse exposure cutting element arrangement.

* * * * *